United States Patent [19]

Tiitola et al.

[11] Patent Number: 4,876,807

[45] Date of Patent: Oct. 31, 1989

[54] SHOE, METHOD FOR MANUFACTURING THE SAME, AND SOLE BLANK THEREFOR

[75] Inventors: Antti-Jussi Tiitola, Kaivanto; Kari Pohja, Mikkeli, both of Finland

[73] Assignee: Karhu-Titan Oy, Finland

[21] Appl. No.: 214,608

[22] Filed: Jul. 1, 1988

[30] Foreign Application Priority Data

Jul. 1, 1987 [FI] Finland ..... 872898

[51] Int. Cl.[4] ..... A43B 5/00

[52] U.S. Cl. ..... 36/114; 12/142 R; 36/14

[58] Field of Search ..... 12/142 R, 146 B, 146 BR; 36/8.3, 14, 19.5, 25 R, 30 R, 31, 45, 55, 77 R, 87, 103, 113, 114, 123, 124, 129

[56] References Cited

U.S. PATENT DOCUMENTS 3,922,800 12/1975 Miller ..... 36/87

FOREIGN PATENT DOCUMENTS 3336126 4/1984 Fed. Rep. of Germany .... 12/142 R
1046203 12/1953 France ..... 36/14
1086185 2/1955 France ..... 36/14
1510380 1/1968 France ..... 36/14

*Primary Examiner*—Steven N. Meyers
*Assistant Examiner*—Diana L. Biefeld
*Attorney, Agent, or Firm*—Steinberg & Raskin

[57] ABSTRACT

A shoe, especially for use in athletic activities such as ball games, having a sole structure including a insole, a flexible midsole, and an outer sole forming a wearing surface. The outer sole in constructed, at least in a toe region of the shoe, in a cuplike form. An upper of the shoe is constructed, also at least in the toe region of the shoe, in a doubled manner, having an inner layer and an outer layer. The outer layer of the upper of the shoe and the outer sole are attached to the shoe, with an upwardly-rising, cuplike edge of the outer sole lying between the inner layer and the outer layer of the upper of the shoe. A method for manufacturing this shoe, and a blank for a sole of the shoe, are also provided by the invention herein.

13 Claims, 5 Drawing Sheets

FIG. A1
PRIOR ART
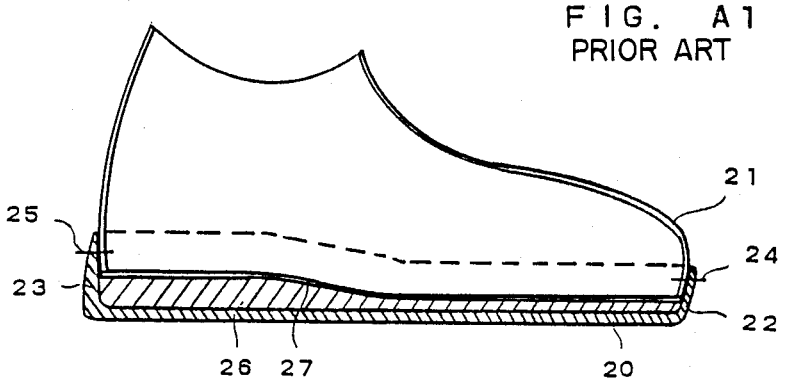
FIG. A2
PRIOR ART
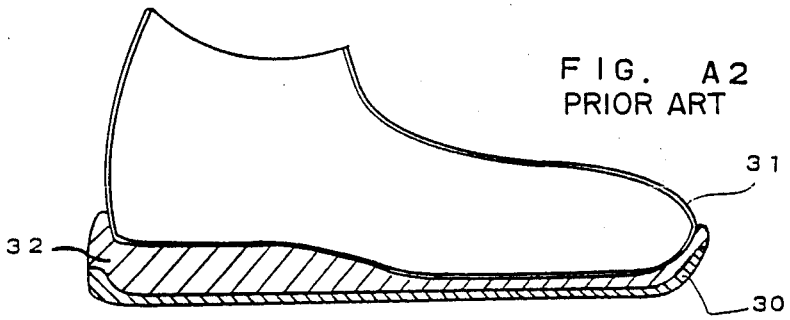
FIG. A3
PRIOR ART
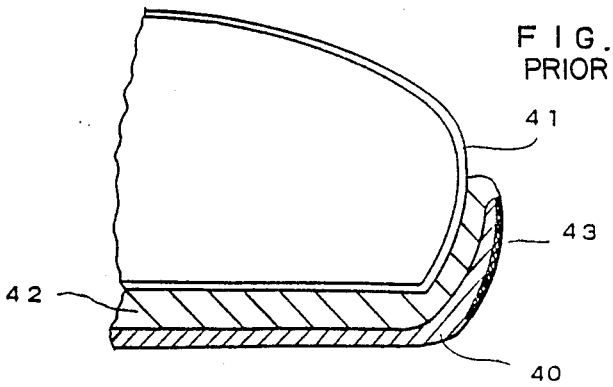

SHOE, METHOD FOR MANUFACTURING THE SAME, AND SOLE BLANK THEREFOR

BACKGROUND OF THE INVENTION

The present invention relates to a shoe, especially intended for sporting activity such as ball games, having a sole structure including an insole, a flexible midsole, and an outer sole forming a surface exposed to wear and which, at least at a toe region of the shoe, is molded into a cuplike form. Additionally, an upper of the shoe is, at least in a toe region of the shoe, constructed to form a doubled structure having an inner layer and an outer layer.

The present invention also relates to a method for manufacturing the shoe, according to which the shoe is constructed using a sole structure of which a part is termed the outer sole and is molded into a cuplike form at least in a toe region thereof, and an upper which, at least in the toe region thereof, is constructed as a double upper having an inner layer and an outer layer.

Furthermore, the present invention relates to a blank for a sole intended for use in applying the above-noted method.

It is common for shoes, in tennis and corresponding ball games or athletic activities, to wear out quite rapidly at a forward edge and a top of the toe portion. This is caused by a player dragging a foot along the ground when reaching out for a ball. Recent developments, particularly in the case of tennis courts, include the surfacing of playing areas with fiber felt, asphalt, rubber asphalt, or some other durable surfacing material on which shoes grip excellently. This has partially contributed to increased wear problems on the part of shoes.

Presently, tennis shoes and other footwear intended for use in ball games or athletic activities, are generally constructed utilizing a so-called cup sole structure. In structures of this type, the edge of the sole of the shoe rises upwardly at every point and joins the upper of the shoe. The purpose of the edge on the sole in structures of this type is, particularly at the toe and edge portions of the shoe, to shield the structure from wear. In certain cases, especially when utilizing structures with rubber soles, the sole is attached by stitching in addition to being glued.

An example of a conventional shoe structure of this type is shown in the form of a schematic cross-sectional view in figure A1. Reference numeral 20 in this figure indicates the sole of the shoe, with reference numeral 21 indicating the upper of the shoe. Additionally, the shoe has a flexible midsole 26 and insole 27, as is conventional practice.

The sole 20 of the shoe is constructed to be cuplike in form, by having its edges rise up. This edge is indicated in FIG. A1 at the front end of the shoe by reference numeral 22, and at the rear end of the shoe by reference numeral 23. The upper 21 is glued onto the sole 20 and to the edges 22, 23 of the sole 20. The adhesion is further secured by stitchings which, in FIG. A1, are denoted by reference numerals 24 and 25.

Despite the stitchings, the weakest part of the shoe is the zone where the edge of the sole 20 meets the upper 21. When a player stretches out for a ball with one foot, the shoe on the other foot of the player drags along the surface of the ground, and along the zone noted above. Initially, this leads to wear along the edge of the sole 20, and eventually to the tearing away of the sole 20 from the upper 21 of the shoe.

Structures implementing directly-molded polyurethane soles, are also used presently in shoes intended for use in ball games or other athletic activities. One such structure is shown in the form of a schematic cross-sectional view in FIG. A2. A shoe of this type has a highly wear-resistant elastomer layer denoted by reference numeral 30 in FIG. A2, as the outermost layer of the sole. The sole proper is molded out of foamy, flexible polyurethane denoted by reference numeral 32 in FIG. 2. The upper 31 of the shoe is attached to the sole 32 by gluing. Due to the limitations by manufacturing techniques, the elastomer layer 30 which serves as the wearing surface cannot be made to extend to the upper edge of the toe of the shoe. Instead, a strip of flexible sole material 32 remains exposed between the elastomer layer 30 and the upper of the shoe 31, as illustrated in FIG. A2.

The weakest part of the structure in shoes of this type is also in the toe. As soon as the material of the sole proper 32 at the toe of the shoe, namely between the upper 31 and the outermost layer 30, has worn away, then the edge of the elastomer layer 30 functioning as the wearing surface begins to peel off, following which the shoe is soon in a state of disrepair.

Steps have recently been taken to reinforce the front edge of the above-noted shoes with polyurethane soles. One such solution is illustrated in the form of a schematic cross-sectional view in FIG. A3, illustrating the toe portion of the shoe. A structure of this type of shoe corresponds in principle to the structure illustrated in FIG. A2. Thus, there is a wear-resistant layer of elastomer 40 as the outermost layer surrounding the sole, within which the sole proper 42 made of foamy, flexible polyurethane is attached to the upper 41 of the shoe by gluing. Additionally, the toe of the shoe is provided with a reinforcement layer 43 which is usually formed of split leather. This reinforcement layer 43 improves the durability of the sole in the area covered by the reinforcement, but does not eliminate the criticality of the zone where the edge of the sole meets the upper of the shoe.

Due to the above phenomenen, a problem shared by all footwear on the market intended for ball games or athletic activities, is weakness of the toe portion of the shoe. Experience has shown that even the most expensive and best tennis shoes last no longer than fifty hours of intensive playing, before breaking down of the toe portion of the shoe.

SUMMARY OF THE INVENTION

Accordingly, it is an object of the present invention to eliminate the above-noted drawbacks with respect to the prior art.

It is also an object of the present invention to significantly improve footwear, especially for use in ball games or other athletic activities.

These and other objects are attained by the present invention which is directed to a shoe having a sole structure including an insole, a flexible midsole, and an outer sole forming a wearing surface, with the outer sole being formed, at least in a toe region of the shoe, with an upwardly extending cuplike edge. Additionally, the shoe comprises an upper having, at least in the toe region of the shoe, an inner layer and an outer layer. The outer layer and the outer sole are attached together, with the upwardly rising cuplike edge of the outer sole lying between the inner and outer layers of the upper of the shoe.

The present invention is also directed to a method for manufacturing a shoe, comprising the steps of providing an outer sole of a shoe with an upwardly rising, cuplike edge, at least in a toe portion of the shoe, and with a flange extending outwardly or downwardly from an outer surface of the cuplike edge, and positioning the outer sole over a last, followed by stretching an outer layer of an upper part of the shoe onto the outer sole, over the cuplike edge thereof, and attaching the outer layer to the outer sole. The outer layer may be additionally attached to an inner layer of the upper part of the shoe and partially to the flange.

Furthermore, the present invention is also directed to a blank for forming an outer sole of a shoe, comprising an upwardly extending cuplike edge, at least in a toe region thereof, and a flange extending outwardly or downwardly from the cuplike edge, for improving adhesion between the cuplike edge and an upper of the shoe. Preferably, a blank for forming the upper of the shoe is also provided, which comprises two layers, namely an outer layer for fastening to an outer surface of the cuplike edge, and an inner layer for fastening to an inner surface of the cuplike edge.

In order to achieve the above-noted objects and others which will become apparent below, a principal characteristic feature of a shoe in accordance with the present invention, is that an outer layer of the upper and the outer sole of the shoe, are attached to the shoe in a manner such that the upwardly-extending, cuplike edge of the outer sole is situated between the inner and outer layers of the upper of the shoe.

A principal characteristic feature of the method in accordance with the present invention, is that an outwardly-extending, additional flange is formed into the upwardly-extending cuplike edge of the outer sole, starting from this cuplike edge, along with an outer layer of the upper of the shoe being stretched and attached to the shoe positioned over a last, in a manner such that at least the lower edge of the outer layer covers the cuplike edge of the outer sole. Additionally, the above-noted extra flange may be partially covered by the lower edge of this outer layer, under certain circumstances.

A principal characteristic feature of a blank for a sole intended for use in implementing the above-noted method of the invention herein, is that a cup-like edge of the sole blank is provided with an outwardly-facing, additional flange for the purpose of improving adhesion between the cuplike edge of the outer sole, and an outer layer of the upper of the shoe.

The shoe structure, method of manufacturing, and sole blank in accordance with the present invention, possess certain advantages over the above-noted prior art solutions, including the following. In the solution provided in accordance with the present invention, it is now possible to protect the weakest part of the shoe which is the zone where the sole of the shoe meets the upper of the shoe. The sturdiness and durability of the toe portion have been significantly improved, because a double-layered upper is used in the front part of the shoe. The durability of the front edge of the sole has also been significantly improved, because of the protected zone where the sole meets the upper of the shoe. Due to the above features, it is possible to manufacture these shoes to be considerably lighter than previously, since there is no need to use extra reinforcements in the front edge of the shoe. Furthermore the outer sole blank in accordance with the present invention, makes it possible to manufacture the shoes mechanically.

As denoted herein, the terms "upper", "lower", "inwardly", and "outwardly", merely refer to positional orientations of shoe in a standard, upright position.

BRIEF DESCRIPTION OF THE DRAWINGS

The present invention will be described in greater detail below, with reference to the accompanying drawings, in which FIGS. A1–A3 illustrate prior art shoe structures, over which the present invention is a distinct improvement.

DESCRIPTION OF THE PREFERRED EMBODIMENTS

Figure 1:
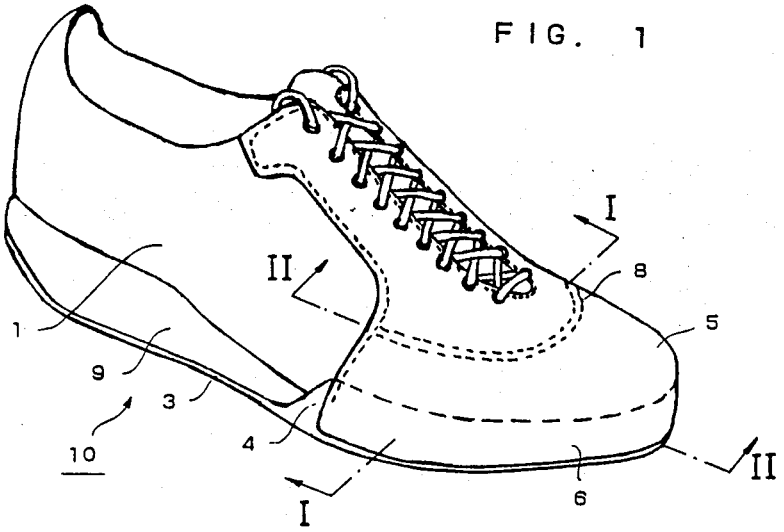
FIG. 1 is a schematic perspective view in accordance with the present invention.

A shoe in accordance with the present invention has generally been denoted by reference numeral 10 in FIG. 1. Shoe 10 comprises an outer sole 3 functioning as a wearing surface, a flexible midsole 9, an insole 2 above the same, and an upper attached to the sole structure of the shoe 10. In the shoe 10 in accordance with the present invention, the upper of the shoe is doubled in the toe region thereof, in a manner to have an inner layer 1 and an outer layer 5. The inner layer 1 of the upper of the shoe is attached to the insole 2 in a conventional manner, either by stitching or gluing. Following this, the midsole 9 and the outer sole 3 are attached onto the insole 2 by gluing, for example. The outer sole 3 is made of rubber, polyurethane or some other suitable material. The outer sole 3 is formed cuplike, at least in the toe region of the shoe 10, in a manner such as to have an upwardly-pointing cuplike edge 4 in the outer sole 3.

Following this, the outer layer 5 of the upper of the shoe is glued onto the inner layer 1 of the upper of the shoe at the toe portion of the shoe 10. The edge of the outer layer 5 extends, at least in the toe region of the shoe 10, over the edge 4 of the outer sole 3. An edge part 6 of the outer layer 5 of the upper of the shoe is also glued to the edge 4 of the sole 3.

In order to achieve an even zone where the outer layer 5 of the upper of the shoe meets the outer sole 3, a recess 7 has been formed into the outer sole 3. The depth of this recess 7 essentially corresponds to the thickness of the outer layer 5 of the upper of the shoe 10. Additionally, FIG. 1 illustrates that the attachment of the outer layer 5 and the inner layer 1 of the upper of the shoe, may be secured by stitchings or stitched reinforcements 8.

It has been explained above that the sole 3 is attached to the midsole 9 and insole 2 by gluing. However, there are also other manners of attaching the outer sole 3 to the midsole 9 and insole 2. Molding is one such technique. Additionally, FIG. 1 illustrates that the outer layer 5 of the upper of the shoe has been made sufficiently long so that it covers, in one piece, the perforated reinforcement for the shoe laces. This is naturally not absolutely necessary, since the principal function of the outer layer 5 of the upper of the shoe, is simply to protect the toe part of the shoes, especially the zone where the upper of the shoe meets the sole.

Figure 3:
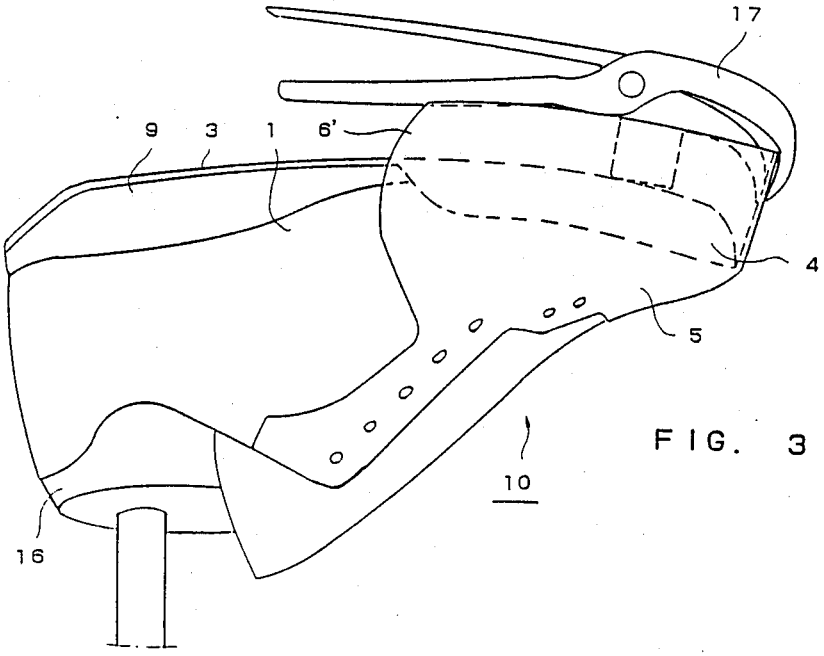
FIG. 3 is a schematic, perspective view of manufacturing of a shoe in accordance with the present invention, utilizing a traditional manual technique.

Particularly problematical stages in the manufacturing of a shoe in accordance with the present invention, are encountered when shaping the outer layer 5 of the upper of the shoe 10 and in gluing it on top of the upwardly-extending cuplike edge 4 of the outer sole 3. The outer layer 5 of the upper of the shoe may be shaped and attached, for example, by implementing traditional manual work technique illustrated in FIG. 3. In accordance with this technique, the sole parts 2, 3, 9 and the inner layer 1 of the upper of the shoe are first attached to one another by using conventional methods, with the shoe 10 being positioned over a last 16.

Next, an underside of the outer layer 5 of the upper of the shoe and the top side of the inner layer 1, along with the outer side of the cuplike edge 4 of the sole 3, are glued utilizing contact glue, which hardens at room temperature. Following this, the outer layer 5 of the upper part of the shoe is stretched using tongs 17, e.g. the stretching tong 17 illustrated in FIG. 3, and then fastened onto the cuplike edge 4 of the sole 3 by utilizing a hammer. The stretching and fastening is commenced from the middle of the toe of the shoe 10, continuing, step by step, along either side towards the rear part of the shoe. Once the outer layer 5 of the upper part of the shoe has been attached, that part 6' of the outer layer 5 of the upper which extends over the outer sole 3 is cut off along the edge of the outer sole 3 utilizing, for example, a conventional shoemaker's knife, following which the cut fringe is smoothed. The above method is, however, slow, requires good craftsmanship, and is suitable, as such, only for the purpose of producing prototypes of the shoes. The above method is not suitable for industrial mass production.

The manufacturing method in accordance with the present invention is intended for the purpose of manufacturing the shoe industrially. The manufacturing method has made it possible to eliminate the negative aspects of manual production. Problems associated with the zone where the outer layer 5 of the upper of the shoe meets the cuplike edge 4 of the outer sole 3, have also been eliminated by this method of manufacturing. A new type of sole blank 18, illustrated in FIGS. 4–6B, has been developed for the purpose of implementing this method of the present invention herein.

Figure 4:
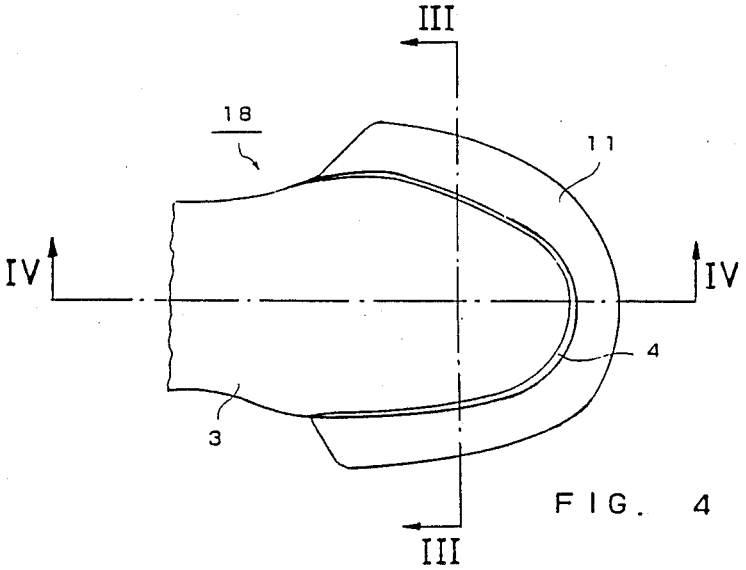
FIG. 4 is a top plan view of an outer sole blank utilized in a mechanical manufacturing of a shoe in accordance with the present invention.

FIG. 4 illustrates a schematic view from above of a toe portion of the outer sole blank 18 in accordance with the present invention. This outer sole blank 18 includes an outer sole 3 where the toe portion also includes an upwardly-rising, cuplike edge 4. The special feature of the blank 18 is an additional or extra flange 11 extending out from the outer surface of the cuplike edge 4 of the blank 18 and pointing outwardly from the cuplike edge 4. The extra flange 11 is, however, cut off from the cuplike edge 4 at the final stage of manufacturing the shoe.

Figure 2A:
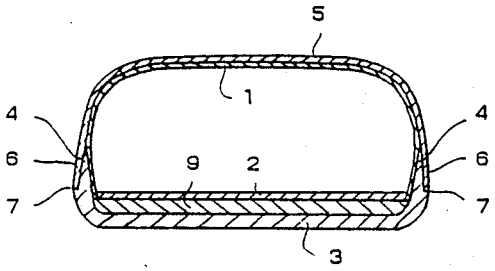
FIG. 2A is a schematic, cross-sectional view along line I—I of FIG. 1 of a toe portion of the shoe in accordance with the present invention.
Figure 2B:
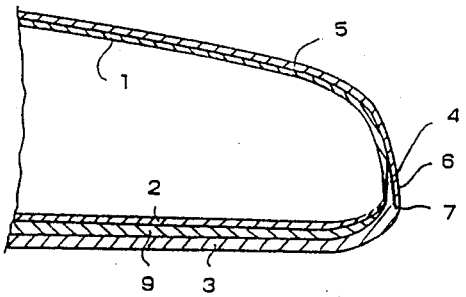
FIG. 2B is a schematic, cross-sectional view along line II—II of FIG. 1, of the toe portion of the shoe in accordance with the present invention.
Figure 5A:
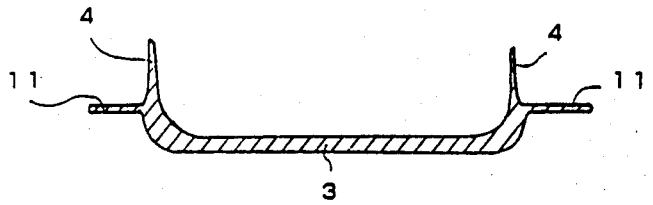
FIG. 5A is a cross-sectional view along line III—III in FIG. 4.
Figure 5B:
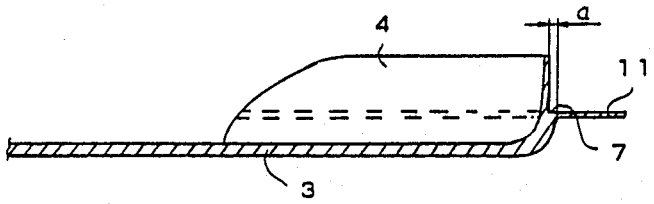
FIG. 5B is a cross-sectional view along line IV—IV in FIG. 4.

FIG. 5A illustrates a cross sectional view along line III—III of the outer sole blank 18 shown in FIG. 4. Similarly, FIG. 5B illustates a cross-sectional view along line IV—IV of the blank 18 illustrated in FIG. 4. In accordance with the implementation illustrated in these figures, the additional flange 11 is constructed to lie substantially parallel with the outer sole 3, i.e. the base thereof, and is positioned to lie slightly above a plane of the outer sole 3 base. Additionally, the region of the cuplike edge 4 of the blank 18 has been shaped in such a manner that the outer surface of the upwardly-rising part of the outer sole 3 lying below the extra flange 11 is situated a certain distance a further out than the outer surface of the cuplike edge 4 lying above the extra flange 11, as best seen in FIG. 5B. This distance a has been suitably selected to correspond substantially to thickness of the outer layer 5 of the upper of the shoe 10. Due to this arrangement, a recess 7 illustrated in FIGS. 2A and 2B is formed into the cuplike edge 4. Thus, the depth of the recess 7 is equal to the distance a. Due to this arrangement, the outer layer 5 of the upper of the shoe and the outer sole 3 join together in a common plane. Such arrangement is especially illustrated in FIG. 5B.

Figure 6A:
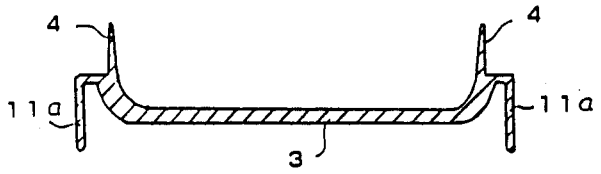
FIG. 6A is a sectional view similar to FIG. 5A and illustrating an alternative sole blank in accordance with the present invention.
Figure 6B:
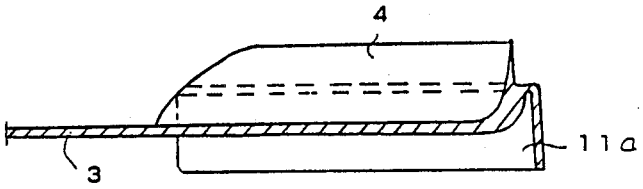
FIG. 6B is a view similar to FIG. 5B and illustrating the sole blank of FIG. 6A.

FIGS. 6A and 6B illustrate another manner of forming an outer sole blank 18 in accordance with the present invention. This embodiment corresponds to the blank illustrated in FIGS. 5A and 5B, with the exception that the extra flange 11*a* does not, in this embodiment, lie entirely parallel with the outer sole 3 and point outwardly from the cuplike edge 4. Instead, for reasons of manufacturing technology, the flange 11*a* is, for a small distance, made to point out from the cuplike edge 4, and is then distinctly bent downwardly. In other words, the extra flange 11*a* is in the shape of a bent flange oriented outwardly from the cuplike edge 4 and directly either straight downwardly, or downwardly at an angle. Such arrangement improves the method of manufacturing in accordance with the present invention, as illustrated in FIGS. 7 and 8.

Figure 7:
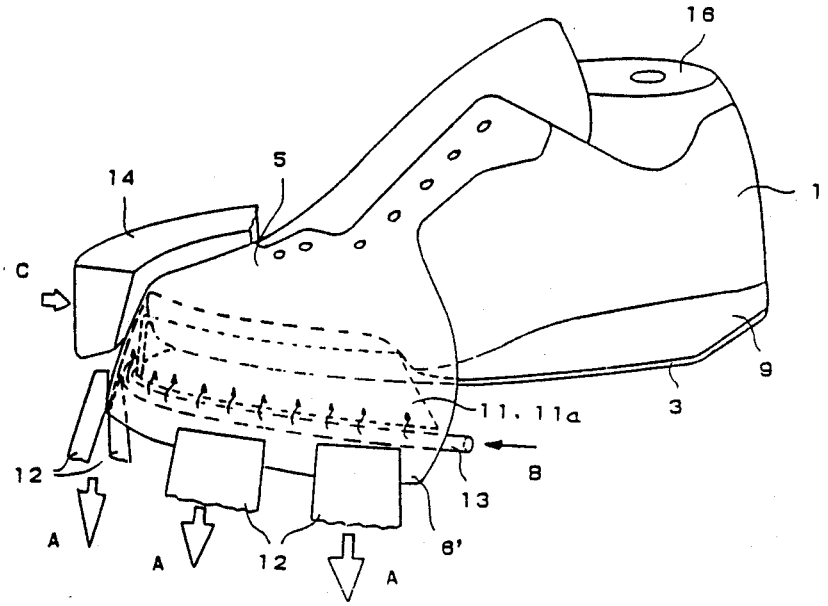
FIG. 7 is a schematic perspective view of the mechanical attachment of an outer layer of an upper of the shoe, to the shoe structure itself in accordance with the present invention.
Figure 8:
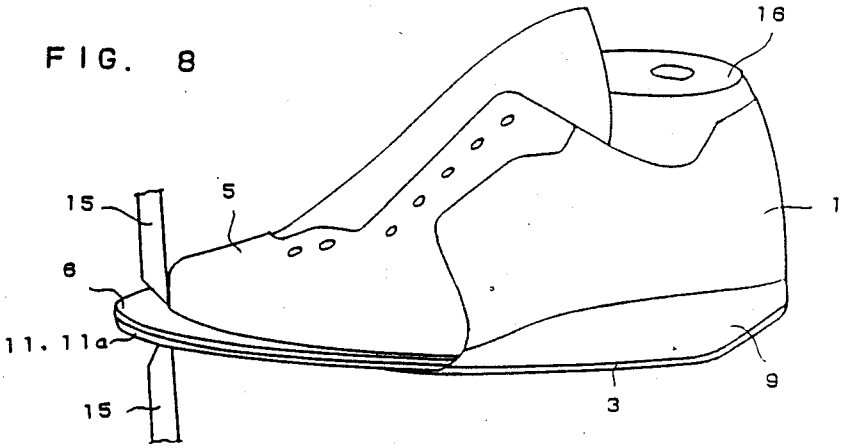
FIG. 8 schematically illustrates a finishing stage of a shoe structure in accordance with the present invention.

In accordance with FIGS. 7 and 8, the manufacturing of the shoe 10, and especially the attaching of the outer layer 5 of the upper to the shoe 10, is carried out utilizing a machine converted from a conventional toe-stretching machine. The stages of operation are as follows. Glue that is readily activated by heat and requires a certain temperature to bring about adhesion, is spread onto the underside of the outer layer 5 of the upper of the shoe, and onto the outside surface of the cuplike edge 4, including the upper surface of the extra flange 11, 11*a*. Following this, the shoe which is positioned over the last 16 is positioned in the toe stretching machine where jaws 12 grip onto edges 6' of the outer layer 5 of the upper of the shoe 10 and stretch the outer layer 5 of the upper over the last 16. The pulling direction of the jaws 12 is denoted in FIG. 7 by arrows A.

If the shoe sole blank 18 utilized in the manufacturing method is the one illustrated in FIGS. 5A and 5B, then the additional flange 11 needs to be bent downwardly in such a manner that the extra flange does not come into contact with the underside of the outer layer 5 of the upper of the shoe. Consequently, the sole blank 18 illustrated in FIGS. 6A and 6B is more advantageous, because the extra flange 11 is already directed downwardly.

Once the outer layer 5 of the upper of the shoe has been stretched over the last 16 in the manner described above, hot air is then blown into the space between the outer layer 5 of the upper and the cuplike edge 4 of the sole 3. To facilitate this, a blow pipe 13 is installed into a conventional toe stretching machine. This blow pipe 13 is curved in a manner to principally correspond to the shape of the toe of the shoe 10. The blow pipe 13 is connected to a hot air blower from which hot air is blown into the blow pipe 13 in the direction denoted by arrow B.

The blowpipe 13 is provided with several apertures to enable hot air to be discharged into the space between the outer layer 5 of the upper of the shoe and the cuplike edge 4 of the outer sole 3. Once hot air has been blown in sufficiently, so that the glued surfaces have been activated, then the glued surfaces are attached to one another by pressing the same together to form a glued bond. The machine is provided with a flexible pressure band 14 for this purpose. This band 14 follows the shape of the toe of the shoe 10 positioned over the last 16. The pressure band 14 has been constructed to be of such a length as to extend around and along the sides of the shoe, at least as far as the outer layer 5 of the upper of the shoe. The pressure direction of the pressure band 14 is illustrated in FIG. 7 by arrow C. The pressure band 14 is flexible, in order to be better able to follow the shape of the toe of the shoe.

Once the glued surfaces have been attached to one another, then the extra flange **11, 11*a* on the cuplike edge 4 of the outer sole 3, together with the outer layer 5 of the upper of the shoe, this outer layer 5 being at least partially glued to the extra flange 11, 11*a*, are turned into a horizontal position to be cut. Following this, the extra flange 11, 11*a* and the surplus part 6' of the upper are cut off following the shape of the toe of the shoe. The cutting operation may be carried out using a machine such as a cutter 15 illustrated in FIG. 8. In other words, once the outer layer 5 of the upper of the shoe has been attached, then the edge part 6, 6' of the outer layer 5 is bent to a substantially horizontal plane, and the extra flange 11, 11*a* is cut off. Preferably, the edge part 6, 6' of the outer layer 5 of the upper of the shoe and the extra flange 11, 11*a* of the outer sole 3** are cut off simultaneously in the same step or operational stage.

By utilizing the above-noted method and the blank 18 therein, a toe structure in a shoe results in which the outer layer 5 of the upper is connected to the cuplike edge 4 of the sole 3 of the shoe, in a manner such that the edge part 6 of the outer layer 5 of the upper is located in a recess 7 formed in the cuplike edge 4 of the outer sole 3, for the purpose of receiving the above-noted edge part 6 of the outer layer 5. Furthermore, the outer surfaces of the outer layer 5 of the upper of the shoe and of the outer sole 3 meet in a substantially common plane.

The present invention has been described above by way of example, and with reference to the accompanying drawings. However, it is not intended to restrict the present invention to the examples presented above. Several variations are possible within the scope of the inventive concepts set forth above. Accordingly, the preceding description of the present invention is merely exemplary, and is not intended to limit the scope thereof in any way.

We claim:

1. A shoe, having a sole structure including an insole, a flexible midsole, and an outer sole forming a wearing surface, said outer sole being formed, at least in a toe region of the shoe, with an upwardly-extending, cup-like edge, and an upper comprising, at least in the toe region of the shoe, an inner layer, and an outer layer, said outer layer and outer sole being attached with said upwardly-rising, cuplike edge of said outer sole lying between said inner and outer layers of said upper.

2. The combination of claim 1, wherein said outer layer is attached to both said inner layer and said cuplike edge by gluing.

3. The combination of claim 1, wherein said cuplike edge is provided with a recess for receiving an edge of said outer layer, with outer surfaces of said outer layer and of said outer sole meeting in substantially the same plane when said outer layer and sole are attached.

4. The combination of claim 1, wherein said outer sole is attached to at least one of said midsole and insole by moulding.

5. The combination of claim 1, wherein said outer sole is attached to at least one of said midsole and insole by gluing.

6. The combination of claim 1, additionally comprising stitching securing said inner and outer layers together.

7. The combination of claim 1, wherein said outer layer extends over said inner layer from the toe portion of the shoe and forms a uniform reinforcement for shoelace holes in the shoe.

8. A contruction of a shoe comprising a blank for forming an outer sole of a shoe, comprising an upwardly extending, cuplike edge, at least in a toe region thereof, a flange extending outwardly from the cuplike edge, for improving adhesion between the cuplike edge and an upper part of the shoe, a blank for forming the upper part of the shoe, and comprising two layers, an outer layer for fastening to an outer surface of the cuplike edge, and an inner layer for fastening to an inner surface of the cuplike edge.

9. The combination of claim 8, wherein said flange extends substantially outwardly and perpendicularly to said cuplike edge.

10. The combination of claim 8, wherein said flange extends substantially downwardly and oppositely to said cuplike edge.

11. The combination of claim 8, wherein said flange extends substantially downwardly at an angle away from said cuplike edge.

12. The combination of claim 8, wherein said flange is attached to said blank at a discrete distance away from the outer surface of said cuplike edge.

13. The combination of claim 12, wherein said discrete distance is substantially equal to width of said outer layer of the upper of the shoe.

* * * * *